US008474378B1

(12) United States Patent
Van Denend

(10) Patent No.: US 8,474,378 B1
(45) Date of Patent: Jul. 2, 2013

(54) CHAMBER BLADE/SEALING ASSEMBLY FOR A PRINTING PRESS

(75) Inventor: Mark E. Van Denend, Paterson, NJ (US)

(73) Assignee: Valley Holdings, LLC, Bryan, OH (US)

( * ) Notice: Subject to any disclaimer, the term of this patent is extended or adjusted under 35 U.S.C. 154(b) by 340 days.

(21) Appl. No.: 13/026,791

(22) Filed: Feb. 14, 2011

Related U.S. Application Data

(63) Continuation-in-part of application No. 12/710,763, filed on Feb. 23, 2010.

(51) Int. Cl.
*B41F 9/10* (2006.01)

(52) U.S. Cl.
USPC ..... 101/169; 101/157; 101/350.6

(58) Field of Classification Search
USPC ..... 101/169
See application file for complete search history.

(56) References Cited

U.S. PATENT DOCUMENTS

| | | | | | |
|---|---|---|---|---|---|
| 273,536 | A | | 3/1883 | Howell, Jr. | |
| 805,100 | A | * | 11/1905 | Silver | 101/169 |
| 1,092,798 | A | * | 4/1914 | Nuttall | 101/169 |
| 2,148,456 | A | | 2/1939 | Grossarth | |
| 2,313,830 | A | | 3/1943 | Lundbye | |
| 2,361,554 | A | | 10/1944 | Lundbye | |
| 2,495,017 | A | * | 1/1950 | Meyer | 101/157 |
| 3,273,536 | A | | 9/1966 | Galer et al. | |
| 3,848,992 | A | | 11/1974 | Smith | |
| 3,848,993 | A | | 11/1974 | Hasiotis | |
| 3,855,927 | A | * | 12/1974 | Simeth | 101/169 |
| 4,060,031 | A | | 11/1977 | Philipp | |
| 4,089,264 | A | | 5/1978 | Jeschke et al. | |
| 4,184,429 | A | | 1/1980 | Widmer | |
| 4,254,709 | A | | 3/1981 | Arnolds | |
| 4,373,445 | A | | 2/1983 | Kobler | |
| 4,378,736 | A | | 4/1983 | Sarda | |
| 4,393,775 | A | | 7/1983 | Cappel et al. | |
| 4,538,518 | A | | 9/1985 | Dahlgren | |
| 4,676,160 | A | | 6/1987 | Linska | |
| 4,773,327 | A | * | 9/1988 | Moetteli | 101/169 |
| 4,821,672 | A | * | 4/1989 | Bruno | 101/169 |
| 5,027,513 | A | | 7/1991 | Allison, Jr. | |
| 5,046,414 | A | | 9/1991 | Oozeki | |
| 5,119,755 | A | * | 6/1992 | Beisswanger | 118/123 |
| 5,150,651 | A | | 9/1992 | Flores | |
| 5,152,221 | A | | 10/1992 | Weeks | |
| 5,237,375 | A | * | 8/1993 | Michlin et al. | 101/169 |

(Continued)

FOREIGN PATENT DOCUMENTS

GB 847173 9/1960

*Primary Examiner* — Jill Culler
(74) *Attorney, Agent, or Firm* — Richard M. Goldberg

(57) ABSTRACT

A chamber blade/sealing assembly for use with a fluid chamber which supplies fluid to a roll, includes a containment blade including an elongated thin plate having opposite ends; and a wear element which increases at least one of stiffness and wear of the thin plate, mounted to a surface of the thin plate at the opposite ends thereof. First and second end seals for sealing first and second ends of the fluid chamber, each include a supporting wall, an upper concave surface on the supporting wall and adapted to engage an outer surface of the roll, and a first upper supporting surface extending from one end of the upper concave surface, the first upper supporting surface adapted to receive the wear element such that the wear element does not substantially increase pressure from the roll on the containment blade at the first upper supporting surface.

20 Claims, 8 Drawing Sheets

U.S. PATENT DOCUMENTS

| | | | | |
|---|---|---|---|---|
| 5,410,961 | A | 5/1995 | DeNicola et al. | |
| 5,483,885 | A | 1/1996 | Leineweber | |
| 5,524,540 | A | 6/1996 | Van Denend | |
| 5,536,312 | A * | 7/1996 | Madrzak et al. | 101/169 |
| 5,638,751 | A | 6/1997 | Daetwyler et al. | |
| 5,662,042 | A | 9/1997 | Compton et al. | |
| 5,713,276 | A * | 2/1998 | Teoh et al. | 101/169 |
| 5,735,210 | A | 4/1998 | Rogge et al. | |
| 5,806,427 | A | 9/1998 | Niemiro et al. | |
| 5,826,296 | A | 10/1998 | Steven | |
| 5,895,150 | A | 4/1999 | Watabe et al. | |
| 5,983,797 | A | 11/1999 | Secor | |
| 5,983,798 | A | 11/1999 | Iijima et al. | |
| 6,016,748 | A | 1/2000 | Kolbe | |
| 6,112,661 | A | 9/2000 | Albiez | |
| 6,202,252 | B1 | 3/2001 | Harrisson | |
| 6,318,259 | B1 | 11/2001 | Chou et al. | |
| 6,360,660 | B1 | 3/2002 | Allison, Jr. | |
| 6,405,649 | B1 * | 6/2002 | Fina | 101/169 |
| 6,412,410 | B1 | 7/2002 | Poullier | |
| 6,526,884 | B1 * | 3/2003 | Bardet et al. | 101/350.6 |
| 6,546,861 | B2 | 4/2003 | Manser | |
| 6,571,703 | B1 | 6/2003 | Metrope | |
| 6,598,525 | B2 | 7/2003 | Metrope | |
| 6,629,496 | B1 | 10/2003 | Boose et al. | |
| 6,672,207 | B2 | 1/2004 | Kolbe et al. | |
| 6,739,248 | B2 | 5/2004 | Kolbe et al. | |
| 6,799,509 | B2 * | 10/2004 | Naniwa | 101/350.1 |
| 7,597,761 | B2 | 10/2009 | Van Denend | |
| 2003/0121435 | A1 | 7/2003 | Jendroska et al. | |
| 2004/0261640 | A1 | 12/2004 | Maccagni et al. | |

* cited by examiner

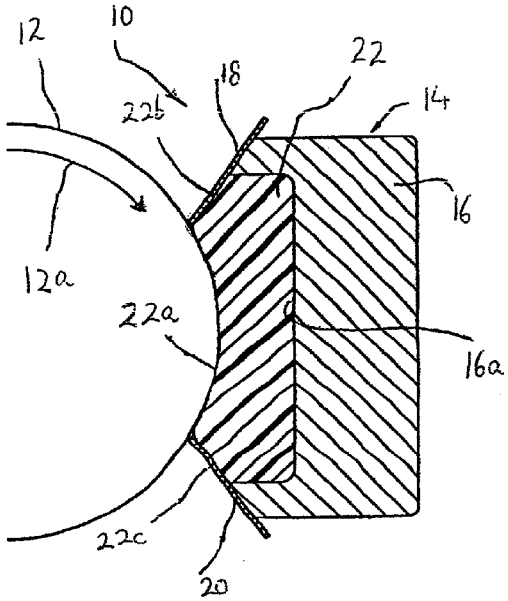
FIG. 1
PRIOR ART
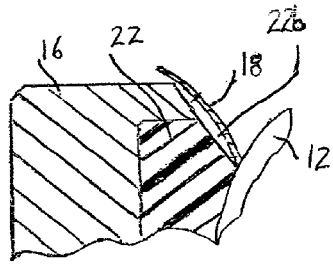
FIG. 3
PRIOR ART
FIG. 2
PRIOR ART
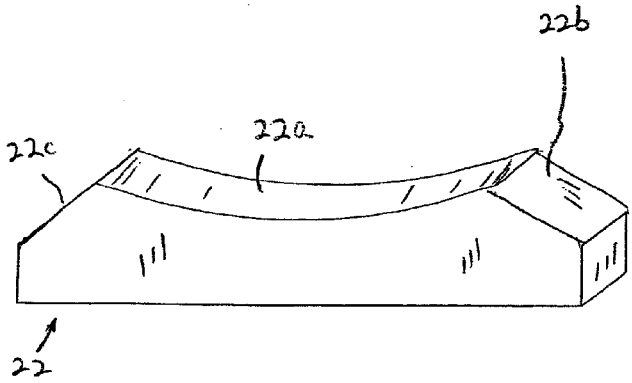

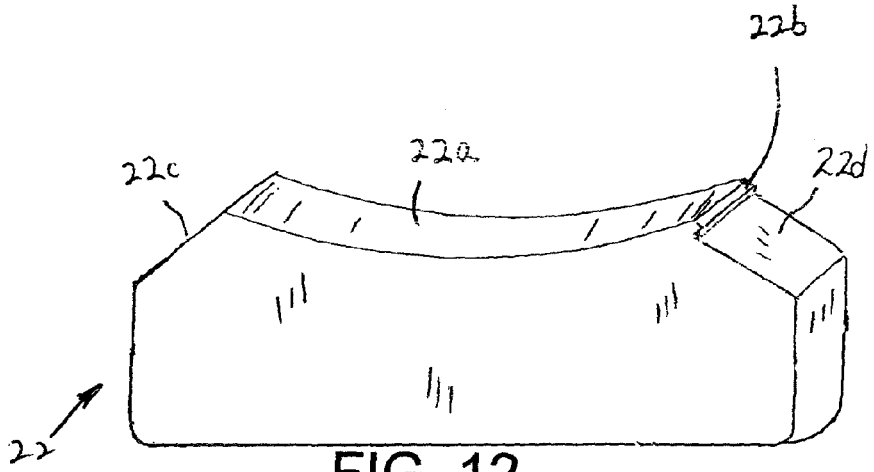
FIG. 12
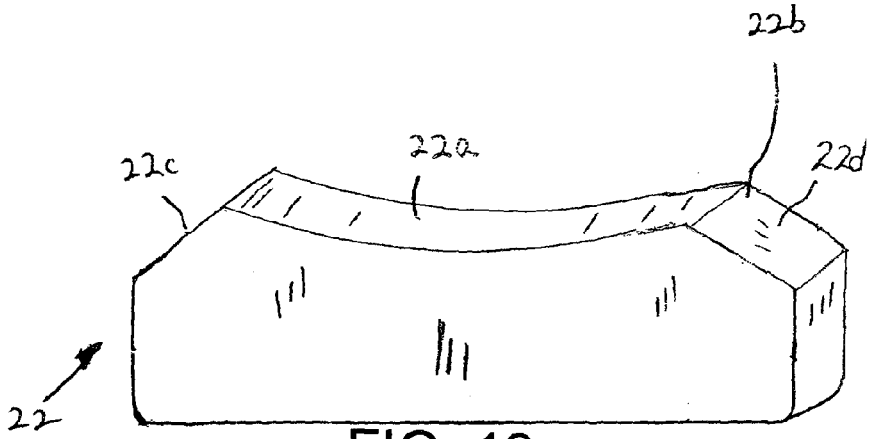
FIG. 13
FIG. 14
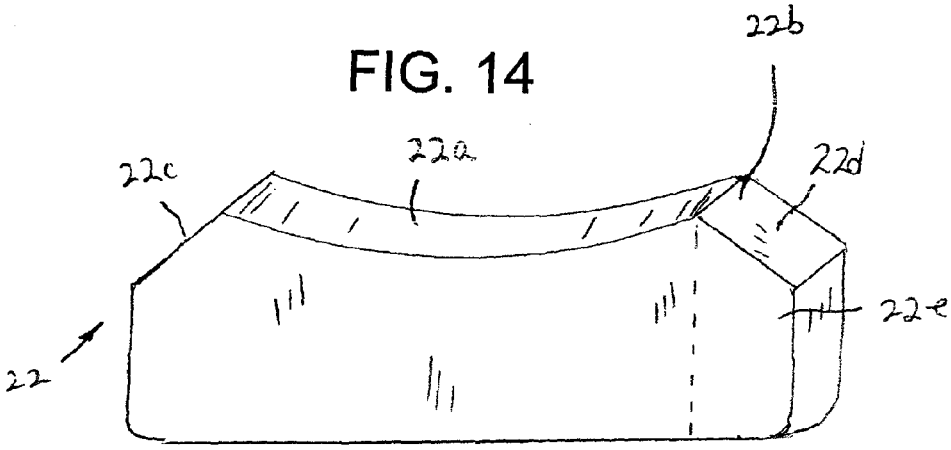

CHAMBER BLADE/SEALING ASSEMBLY FOR A PRINTING PRESS

REFERENCE TO RELATED APPLICATION

The present application is a continuation-in-part of pending U.S. patent application Ser. No. 12/710,763, filed Feb. 23, 2010 and having one of the inventors thereof as the common inventor herein and entitled IMPROVED DOCTOR/CONTAINMENT BLADE FOR A PRINTING PRESS.

BACKGROUND OF THE INVENTION

The present invention relates to a sealing assembly for an ink chamber associated with an anilox roll and chamber blade assembly, and more particularly, is directed to an improved doctor/containment blade with an improved blade/seal area between the doctor blade and containment blade and the chamber seal.

Conventionally, in printing machines, such as flexographic printing machines, an ink transfer or anilox roll transfers ink to an adjacent plate roll for printing. Ink is supplied to the anilox roll from an ink chamber defined by a chamber housing which partially surrounds the anilox roll. Specifically, ink is supplied through an ink supply tube and then through an ink supply line in the chamber housing, into the ink chamber. In like manner, ink is removed from the ink chamber through an ink return line in the chamber housing and then through an ink return tube.

In order to prevent the escape of ink from the chamber, while ensuring that the ink enters the cells in the anilox roll and has a predetermined volume on the anilox roll, doctor and containment blades are provided at the exit and entry positions of the anilox roll relative to the ink chamber. The blades are fixed to the chamber housing so that the blades overhang the chamber housing and contact the anilox roll.

With this arrangement, the outer surface of the anilox roll passes through the ink chamber and picks up ink for printing. The ink is metered by means of the doctor blade held to the outlet end of the chamber housing, and sealed with a containment blade held to the inlet end, with the free ends of the blades being in contact with the outer surface of the anilox roll.

A seal is provided at each end of the blade, that is, at each end of an anilox roll for sealing the ends thereof. Examples of such arrangements are shown in U.S. Pat. Nos. 6,739,248; 6,672,207; 6,598,525; 5,983,797; 5,735,210; 5,662,042; and 5,150,651.

Examples of doctor blades used in such arrangement are shown in U.S. Pat. Nos. 5,638,751 and 6,546,861.

Each seal is formed by a compressible or deformable body. Since the seals provided at each end of the anilox roll function to seal the ends of the ink chamber, each seal must lie against the peripheral surface of the rotating anilox roller. As a result, each seal is therefore exposed to mechanical stresses as well as wear. Further, during the printing operation, the blades, which press against the anilox roll, also wear. The geometry of the sealing function between the anilox roll, the two blades and the end seal changes.

Conventionally, each end of a blade sits upon a flat supporting area of the respective seal. As a result, a gap may be created at the opposite ends of the blades where they are held by the chamber seals. However, there is uneven wear on the ends of the blades adjacent the seals, which tends to cause leakage of ink at the ends of the anilox roll. As the doctor blades are forced against the anilox roll and, in particular, when the doctor blades wear unevenly in the sealing area, the sealing and doctor blades may flex or bow outwardly relative to the flat supporting area of the seal, due in part to the flimsiness of the thin blades, pressure on the blades, dried ink under the blades, fluid pressure in the chamber, etc. Thus, the areas where the anilox roll, blades and seals join are susceptible to leakage because of geometric changes.

The above U.S. patent application Ser. No. 12/710,763 provides a solution to the above problems by providing an improved doctor blade and containment blade with additional wear resistance, improved leakage resistance, increased rigidity and increased wear life at the position of the end seals. This is accomplished by a wear element which increases the stiffness and/or wear of the thin plate of the blades, the wear element mounted to a surface of the thin plate at least at a position corresponding to the end seals, such that the thickness of the reinforced blade is greater at the opposite ends thereof which lie against the seals than at positions thereof between the end seals.

However, the wear element increases the thickness of the blade thereat. Because of the extra thickness thereat, when the wear element hits the anilox roll, there is increased force by the anilox roll on the blade at this position, which can result in undesirable effects. Specifically, because of this increased force on the blade, the blade wears faster thereat, even though the life of the blade at this position is still longer than a blade without the wear element. There are also wiping problems thereat which can cause dripping of the ink.

SUMMARY OF THE INVENTION

Accordingly, it is an object of the present invention to provide an improved containment blade with an improved sealing function with the seals associated therewith at the ends of the ink chamber.

It is another object of the present invention to provide an improved containment blade with additional wear resistance at the position of the end seals.

It is a still further object of the present invention to provide an improved containment blade that provides improved leakage resistance at the end seals.

It is a yet further object of the present invention to provide an improved containment blade that provides increased wear life thereof.

It is another object of the present invention to provide an improved containment blade having increased rigidity at the end seals.

It is still another object of the present invention to provide an improved containment blade that eliminates the aforementioned wiping problems.

It is yet another object of the present invention to provide an improved containment blade that is easy to use and economical to manufacture.

In accordance with an aspect of the present invention, a chamber blade/sealing assembly for use with a fluid chamber which supplies fluid to a roll, includes a containment blade including an elongated thin plate having opposite ends; and a wear element which increases at least one of stiffness and wear of the thin plate, the wear element mounted to a surface of the thin plate at the opposite ends thereof. First and second end seals for sealing first and second ends of the fluid chamber are provided. Each of the first and second end seals include at least one supporting wall, an upper concave surface on the at least one supporting wall and adapted to engage an outer surface of the roll, and a first upper supporting surface extending from one end of the upper concave surface, the first upper supporting surface adapted to receive the wear element such that the wear element does not substantially increase pressure from the roll on the containment blade at the first upper supporting surface.

In one embodiment, the first upper supporting surface includes a recess therein, and the wear element is positioned within the recess. The recess can be bounded by a raised wall at at least one end thereof. Preferably, the wear element has a shape and dimensions similar to those of the recess.

Preferably, the wear element is a plate material made from the same material as the blade, and has a thickness at least equal to a thickness of the blade.

The first upper supporting surfaces are formed by downwardly sloping flat supporting surfaces which continue at an angle from one edge of the upper concave surface.

In addition, a height of each first upper supporting surface at any point thereon is lower than would be required for a chamber blade/sealing assembly without said wear element, in order to account for extra thickness of the containment blade and wear element together.

The end seal is made of one of a compressible and deformable material, and the compressible and deformable material of a portion of said seal containing the first upper supporting surface has a durometer which is less than a durometer of the compressible and deformable material of a remainder of said seal.

In accordance with another aspect of the present invention, a chamber blade/sealing assembly for use with a fluid chamber which supplies fluid to a roll, includes a containment blade including an elongated thin plate having opposite ends; and a wear element which increases at least one of stiffness and wear of the thin plate, the wear element mounted to a surface of the thin plate at the opposite ends thereof. First and second end seals for sealing first and second ends of the fluid chamber are provided. Each of the first and second end seals include at least one supporting wall, an upper concave surface on the at least one supporting wall and adapted to engage an outer surface of the roll, and a first upper supporting surface extending from one end of the upper concave surface, the first upper supporting surface adapted to receive the wear element such that an effective thickness of the containment blade and the wear element together between the seal and the roll remains substantially the same as the thickness of the containment blade alone.

The above and other objects, features and advantages of the invention will become readily apparent from the following detailed description thereof which is to be read in connection with the accompanying drawings.

BRIEF DESCRIPTION OF THE DRAWINGS

FIG. 1 is a cross-sectional view of a conventional blade seal associated with an anilox roll;

FIG. 2 is a perspective view of the seal of FIG. 1;

FIG. 3 is a cross-sectional view of the conventional seal of FIG. 1, showing the containment blade bending away from the seal;

FIG. 12 is a perspective view of an end seal according to another embodiment of the present invention;

FIG. 13 is a perspective view of an end seal according to still another embodiment of the present invention; and FIG. 14 is a perspective view of an end seal according to yet another embodiment of the present invention.

DETAILED DESCRIPTION

Figure 4:
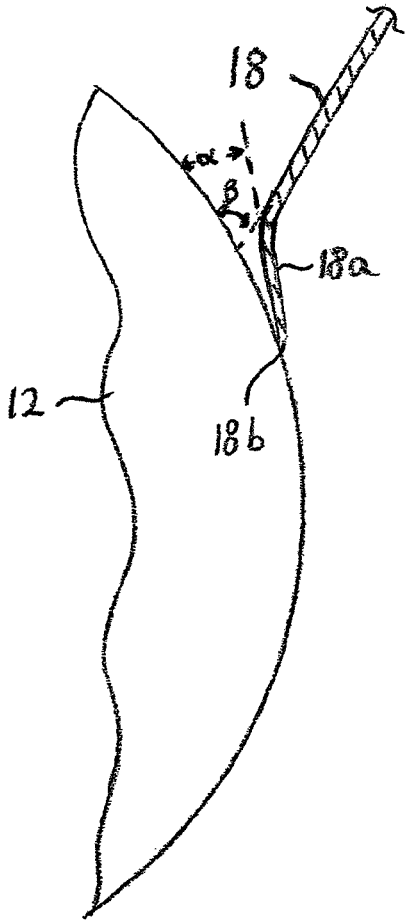
FIG. 4 PRIOR ART
FIG. 4 is a side elevation view of a modified containment blade according to the prior art.

Referring to the drawings in detail, and initially to FIGS. 1-4 thereof, there is shown a conventional sealing assembly 10 for doctor and containment blades. Conventionally, in printing machines, such as flexographic printing machines, an ink transfer or anilox roll 12 transfers ink to an adjacent plate roll (not shown) for printing. Ink is supplied to anilox roll 12 from an ink chamber 14 defined by a chamber housing 16 which is adjacent to and may partially surrounds anilox roll 12. Anilox roll 12 rotates in the direction of arrow 12*a*.

In order to prevent the escape of ink from ink chamber 14, while ensuring that the ink enters the cells in anilox roll 12 and has a predetermined volume on anilox roll 12, an elongated sealing or containment blade 18 and an elongated doctor blade 20 are provided at the entry and exit positions of anilox roll 12 relative to ink chamber 14. Blades 18 and 20 each include a clamping portion that is fixed to chamber housing 16 by a blade holder (not shown) at a position beyond the chamber housing 16, as is well known in the art, so that blades 18 and 20 overhang chamber housing 16 and contact anilox roll 12. Blades 18 and 20 are placed at an angle against the periphery of anilox roll 12 and help to define ink chamber 14 which extends along the length of anilox roll 12.

Seals 22 are provided at each end of anilox roll 12 to seal the ends of ink chamber 14. Each seal 22 has an upper concave surface 22*a* which lies against the peripheral surface of the rotating anilox roll 12. The edges of upper concave surface 22*a* continue in downwardly sloping supporting surfaces 22*b* and 22*c* which support blades 18 and 20, respectively.

With this arrangement, the outer surface of anilox roll 12 passes through ink chamber 14 and picks up ink for printing. The ink is metered by means of doctor blade 20 held to the outlet end of chamber housing 16, and sealed with containment blade 18 held to the inlet end, with the roll contact portions, that is, the free contact edges, of blades 18 and 20 being in contact with the outer surface of anilox roll 12.

However, each end of blades 18 and 20 sits upon a supporting surface 22*b* or 22*c* of a respective seal 22. As a result, in part because of the flimsiness or thinness of the blades, a gap may be created at the opposite ends of the blades 18 and 20 where they are in contact with the chamber seal 22. Because there is uneven wear of blades 18 and 20 adjacent seals 22, this tends to cause leakage of ink at the ends of anilox roll 12. In such case, the sealing and doctor blades 18 and 20 may flex or bow outwardly relative to the supporting surfaces 22*b* and 22*c* of the respective seal 22, as shown in FIG. 3. Thus, the areas where anilox roll 12, blades 18 and 20 and seals 22 join are susceptible to leakage because of geometric changes.

In addition, another problem at the end seals is that of back blading. Specifically, as anilox roll 12 rotates, each position thereon reenters the ink chamber 16. During this rotation when containment blade 18 is the upper blade, ink thereat catches on containment blade 18 and builds up at this position. The ink then builds up and runs along the interface of containment blade 18 and anilox roll 12, and drips down from the edge of containment blade 18 in the seal area. When containment blade 18 is the lower blade, the ink merely drips down and creates stalactites of ink.

As a result, in order to prevent or limit back blading, it is known to increase the width of containment blade 18, for example, from 25 mm to 35 mm, with the extra width section 18*a* thereof being bent such that the portion of containment blade 18 in contact with anilox roll 12 is at an acute angle α which is much less than the angle β of contact of a conventional 25 mm blade, as shown in FIG. 4. Such an increased width blade is sold by Paper Converting Machine Co. of Green Bay, Wis. However, in such known arrangement, the section of extra width portion 18*a* that would normally lie between anilox roll 12 and seal 22 is cut away. In other words, extra width portion 18*a* only exists between seals 22, but not at seals 22. This is because the geometry of the blade 18 must be taken into considered for transitioning between the straight seal surfaces 22*b* and 22*c* and the round surface of anilox roll 12, and the cut-out portion must be determined ahead of time in order to determine how the blade will lie against anilox roll 12 and seal surfaces 22*b* and 22*c*. The geometry of the cut-away portion can also change in dependence on the position of the chamber relative to anilox roll 12.

Figure 5:
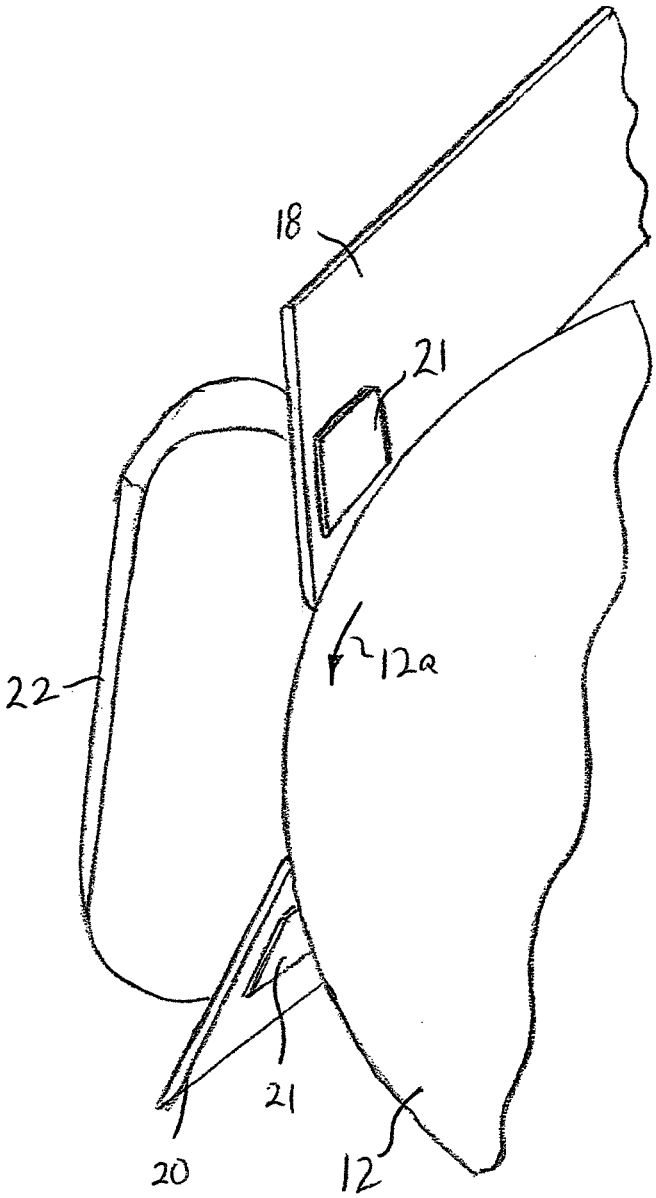
FIG. 5 is a perspective view of a doctor blade and containment blade according to the invention of U.S. patent application Ser. No. 12/710,763, in association with an end seal and an anilox roll.
Figure 6:
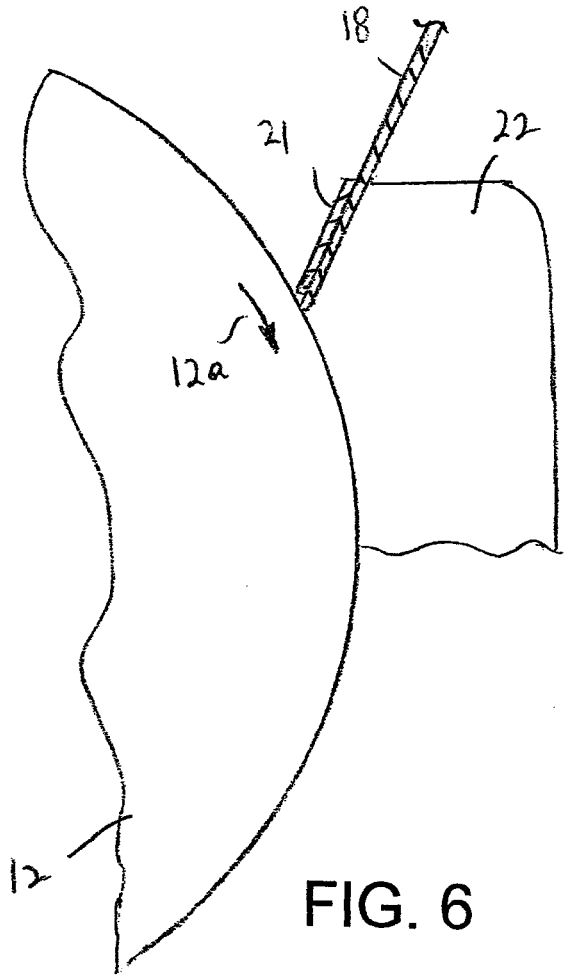
FIG. 6 is a side elevation view, partly in cross-section, of the arrangement of FIG. 5, but showing only the containment blade.

Referring now to FIGS. 5 and 6, blades 18, 20 according to the invention of U.S. patent application Ser. No. 12/710,763, each include a wear element 21 fixedly mounted thereon at a position at or spaced slightly from the initial roll contact portion of each blade 18, 20 with anilox roll 12, and positioned at least in the area where each blade 18, 20 lies on downwardly sloping flat supporting surfaces 22*b* and 22*c* of seal 22, and may even extend into the clamped portions thereof. Preferably, each wear element 21 extends in the lengthwise direction of each blade 18, 20 so as to at least partially overlap downwardly sloping flat supporting surfaces 22*b* and 22*c* in that lengthwise direction. However, the length of each wear element 21 can be less than or greater than the dimension of each downwardly sloping flat supporting surface 22*b* and 22*c* in the lengthwise direction of each blade 18, 20. If wear element 21 also extends, for example, partially or entirely across the entire blade, it is important that wear element 21 have a greater thickness in areas where it overlaps downwardly sloping flat supporting surfaces 22*b* and 22*c*. Thus, it will be appreciated that, even if wear elements 21 extend between the seal areas, the thickness of wear elements 21 is greatest at the seal areas, so that the rigidity of blades 18, 20 is increased greatly at the seal areas.

The width of each wear element 21 preferably extends to the outer edge of the respective flat supporting surface 22*b* and 22*c*, but is not limited thereto, and may vary in width therefrom. Each wear element 21 can be of any suitable thickness. Wear element 21 can be made of any suitable material, such as the same material as blades 18, 20.

With wear elements 21 added to each blade 18, 20, the rigidity of each blade 18,20 at downwardly sloping flat supporting surfaces 22*b* and 22*c* of seal 22, is increased. As a result, there is much less tendency for each blade 18, to bow at the position of seals 22. In effect, each wear element 21 inhibits or prevents ink from entering into the area between blades 18, 20 and downwardly sloping flat supporting surfaces 22*b* and 22*c* of seals 22, thereby inhibiting or preventing leakage of ink at the seal areas.

It is noted that, at each seal area, the respective blade 18, 20 may wear down faster than at areas between the seal areas where the blades 18, 20 are in contact with anilox roll 12, since there is little or no lubricating ink at the seal areas. As a result, an opening may develop in each blade 18, 20 at the seal areas through which ink can leak, particularly if the blades 18, 20 are bowed outwardly. This ink leakage under the blades 18, 20 tends to push the respective blades 18, 20 further away from downwardly sloping flat supporting surfaces 22*b* and 22*c* of seal 22, which results in further leakage of ink thereat. By providing the extra material thickness of wear elements 21, even if a wear opening is provided in each blade 18, 20, the blade is not pushed away from downwardly sloping flat supporting surfaces 22*b* and 22*c* of seal 22, due to the increased rigidity of the blades 18, 20 at the seal areas, so that there is little or no ink leakage. Further, as the blade wears down in the seal area, the anilox roll 12 comes into contact with the increased thickness wear element 21, whereby the additional material of wear element 21 functions to increase the wear life of the blade.

It will be appreciated that, while wear element 21 is preferably secured to blades 18, 20, it may be provided as a separate element held by the machine and which lies against the same area of blades 18, 20 described herein. Therefore, reference to wear element 21 being "mounted" refers to wear element 21 being fixed to blades 18, 20, or as a separate element pressed thereagainst.

Figure 7:
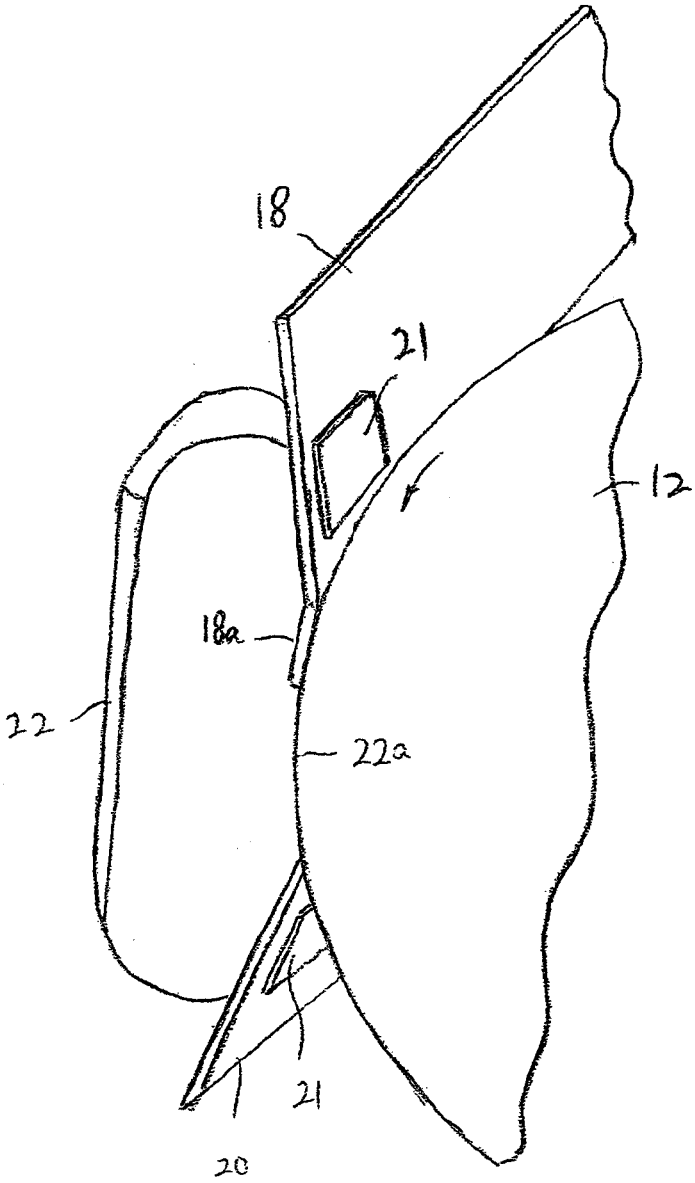
FIG. 7 is a perspective view of a modified containment blade according to the invention of U.S. patent application Ser. No. 12/710,763, in association with an end seal and an anilox roll.
Figure 8:
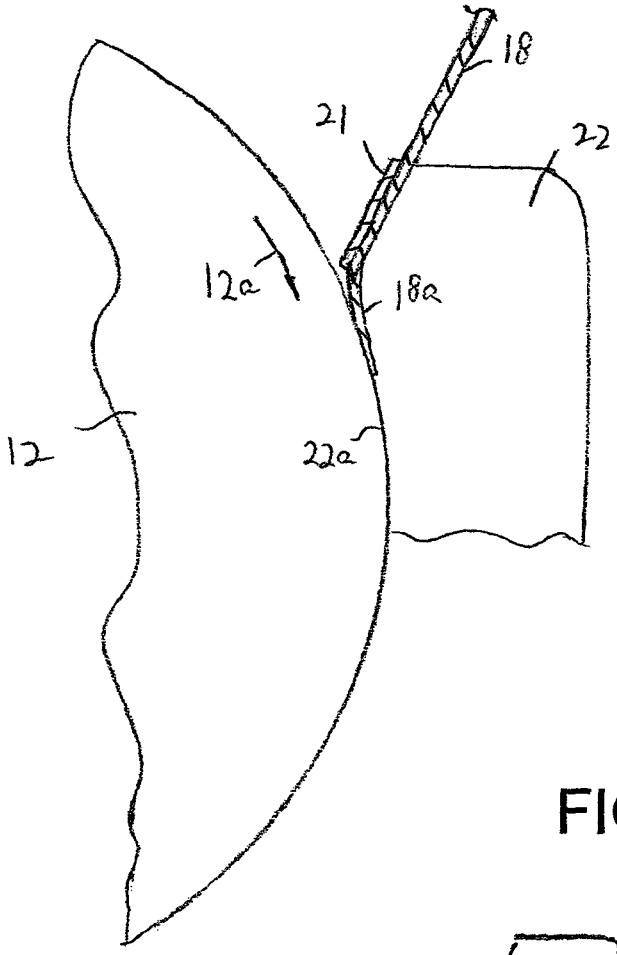
FIG. 8 is a side elevation view of the arrangement of FIG. 7, but showing only the containment blade.

Further, as shown in FIGS. 7 and 8, if the width of containment blade 18, is increased, for example, from 25 mm to 30 mm or 35 mm, with the extra width section 18*a* thereof being bent such that the portion of containment blade 18 in contact with anilox roll 12 is at an acute angle α which is much less than the angle 13 of contact of a conventional 25 mm blade, as shown in FIG. 4, but in which the extra width section 18*a* is not cut away at the seal areas, contrary to the blades sold by Paper Converting Machine Co. of Green Bay, Wis., each wear element 21 functions to increase the wear life of the blade, while also preventing or inhibiting back blading. Specifically, the section of extra width portion 18*a* that would normally lie between anilox roll 12 and seal 22 is not cut away.

Figure 9:
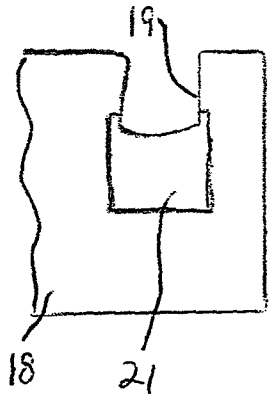
FIG. 9 is a top plan view showing wearing of a containment blade at the end where it seats on the end seal.

In such case, extra width portion 18*a* is also positioned between anilox roll 12 and seal 22, as shown in FIGS. 7 and 8. In this position, extra width portion 18*a* sinks into the compressible or deformable material of seal 22 so that the inner surface of extra width portion 18*a* is flush or coextensive with the inner arcuate surface 22*a* of seal 22. In this regard, seal 22 is made of any suitable deformable or compressible material, such as felt, a closed cell foam or an elastomeric material having a desired durometer. The pressure of anilox roll 12 on extra width portion 18*a* results in wear of this extra width portion 18*a*, creating an open area 19, as shown in FIG. 9. This wearing of containment blade 18 at this position results in wearing away open area 19 (FIG. 9) of blade 18 through which ink can leak between blade 18 and end seals 22 at the ends of anilox roll 12. Because there is uneven wear of blade 18 adjacent seals 22, this would normally tend to cause leakage of ink at the ends of anilox roll 12.

However, by additionally providing wear element 21, leakage does not occur, even with such open area 19. As a result, in tests performed by the applicant herein, a containment blade 18 with an extra width portion 18*a* but without wear elements 21, leaked in a flexographic printing machine in about 12 hours. However, the same blade 18 in the same flexographic printing machine and under the same conditions, but with wear elements 21 added of the same material and thickness as blade 18, was still functioning with little or no ink leakage even after 24 hours of operation, even though a similar open area 19 was created. Because wear element 21 is in contact with anilox roll 12, the wear life of blade 18 is greatly increased.

Thus, the invention of U.S. patent application Ser. No. 12/710,763, provides that the material of blade 18 is sufficiently flexible to bend and pass between anilox roll 12 and seal 22, while made sufficiently rigid by wear element 21 to prevent leakage beneath blade 18, even when worn away to provide an open area 19 thereof.

Although wear element 21 has been shown mounted on the outer surface of each blade 18, 20 outside of the ink chamber, it can be mounted on the inner surface within the ink chamber.

The invention of the above U.S. patent application Ser. No. 12/710,763 thereby provides an improved doctor blade and containment blade with additional wear resistance, improved leakage resistance, increased rigidity and increased wear life at the position of the end seals. This is accomplished by a wear element which increases the stiffness and/or wear of the thin plate of the blades, the wear element mounted to a surface of the thin plate at least at a position corresponding to the end seals, such that the thickness of the reinforced blade is greater at the opposite ends thereof which lie against the seals than at positions thereof between the end seals.

However, wear element 21 increases the thickness of the blade thereat. Because of the extra thickness thereat, when wear element 21 hits the anilox roll, there is increased force by the anilox roll on the blade at this position, which can result in undesirable effects. Specifically, because of this increased force on the blade, the blade wears faster thereat, even though the life of the blade at this position is still longer than a blade without wear element 21. There are also wiping problems thereat which can cause dripping of the ink.

Figure 10:
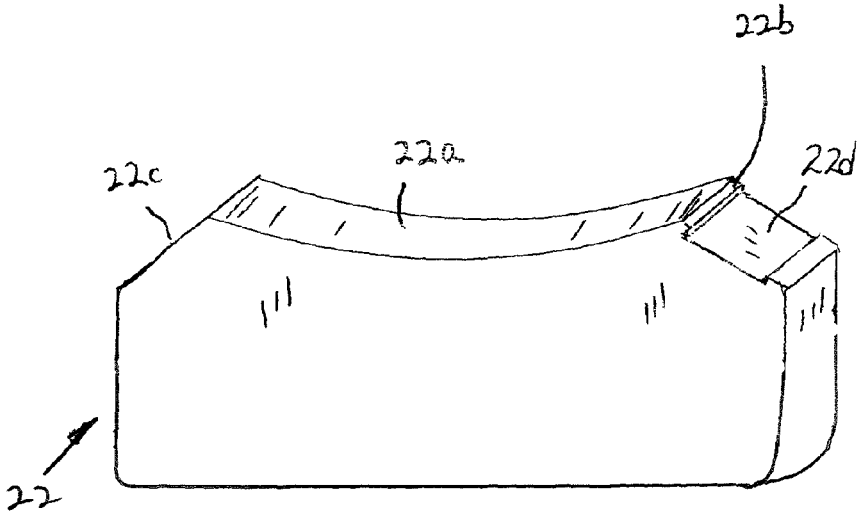
FIG. 10 is a perspective view of an end seal according to one embodiment of the present invention.
Figure 11:
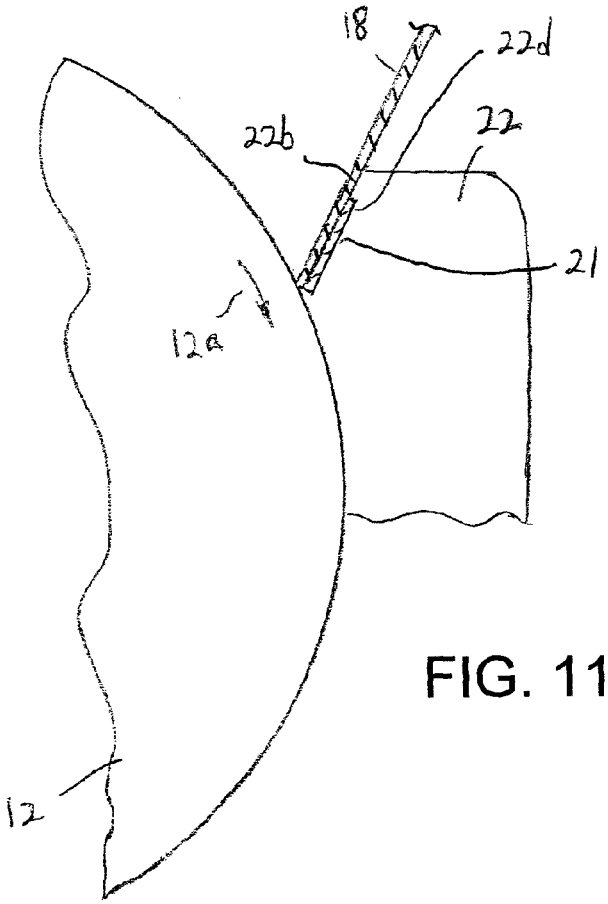
FIG. 11 is a side elevation view, partly in cross-section, showing the containment blade according to FIG. 10, in association with an end seal and an anilox roll.

Referring now to FIGS. 10 and 11, the present invention overcomes this problem of increased force on the blade and the wiping problems. Specifically, wear element 21 is secured to the opposite surface of containment blade 18. Further, downwardly sloping supporting surface 22*b* of seal 22, which supports containment blade 18 includes a recess 22*d* which is preferably, but not limited to, configured to have dimensions similar to or smaller than wear element 21, and a depth similar to the initial thickness of wear element 21 so that the outer surface of wear element 21 is coplanar with downwardly sloping supporting surface 22*b* of seal 22. As a result, the effective thickness of containment blade 18 and wear element 21 against anilox roll 12 is the same as the thickness of containment blade 18 at other positions without wear element 21. This means that there is no increased force by anilox roll 12 on containment blade 18 at this position. Therefore, since there is no increased force on containment blade 18, containment blade 18 does not wear faster at the position of wear element 21. However, because of wear element 21, even if there is wear through containment blade 18 at this position, there is still wear element 21 thereat, which greatly increases the life of containment blade 18 over conventional containment blades 18 without wear element and increases the life over containment blade 18 with wear element 21 according to U.S. patent application Ser. No. 12/710,763. In addition, because there is no increased force at this position, the wiping problems associated with containment blade 18 of U.S. patent application Ser. No. 12/710,763, are not present, thereby avoiding the problem of dripping of ink.

It will be appreciated that the present invention is also applicable to the modification of FIGS. 7-9 herein.

It will be appreciated that, instead of a recess 22*d* which is bounded at opposite ends thereof by raised walls, as shown in FIG. 10, recess 22*d* can be bounded by a raised wall at only one end, for example, the upper end, as shown in FIG. 12. Alternatively, in place of a recess 22*d*, downwardly sloping supporting surface 22*b* can merely be provided with a height at any point thereon which is lower than would be required for a chamber blade/sealing assembly without wear element 21, in order to account for extra thickness of the containment blade 18 and wear element 21 together. The latter modification, in effect, provides an effective recess 22*d* which is unbounded by raised walls, that is, there are no raised walls at either end thereof.

As a further alternative, in place or recess 22*d* or lower height downwardly sloping supporting surface 22*b*, the height of downwardly sloping supporting surface 22*b* can be the same as that of a downwardly sloping supporting surface 22*c* which would be required for a chamber blade/sealing assembly without wear element 21. However, at least a portion 22*e* of seal 22 shown by dashed lines in FIG. 14, at downwardly sloping supporting surface 22*b*, is formed from a material that has a durometer that is lower than the durometer of the material of the remainder of seal 22. In such case, wear element 21 would sink further into the material of seal 22 at downwardly sloping supporting surface 22*b*, so that the effective thickness of wear element 21 and containment blade 18 at this position, as seen in the side view, is effectively the same as containment blade 18 alone, so that wear element 21 does not increase the pressure thereat. Portion 22*e* can be modified from that shown in FIG. 14, as long as the desired effect is still achieved.

It will be appreciated that combinations of the above embodiments can be provided. For example, the recess 22*d* or lowered height downwardly sloping supporting surface 22*b* need not have a height corresponding to the thickness of wear element 21, but can have a height less than the thickness of wear element 21. In such case, recess 22*d* or lowered height downwardly sloping supporting surface 22*b* can be combined with a lower durometer material thereat to provide the same result.

The key to all of the above embodiments is that wear element 21 increases the life of containment blade 18, while not increasing the pressure or force thereon at the position of end seal 22.

In this regard, it will be appreciated that containment blade 18, rather than wear element 21, can be in direct contact with downwardly sloping supporting surface 22*b* or recess 22*d*, as long as the effective thickness of containment blade 18 and wear element 21 between seal 22 and roll 12 remains substantially the same as the thickness of containment blade 18 alone.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A chamber blade/sealing assembly for use with a fluid chamber which supplies fluid to a roll, said chamber blade/sealing assembly comprising:

a containment blade including an elongated thin plate having opposite ends;

a wear element which increases at least one of stiffness and wear of the thin plate, the wear element mounted to a surface of the thin plate at said opposite ends thereof; and first and second end seals for sealing first and second ends of the fluid chamber, each of said first and second end seals including:

at least one supporting wall, an upper concave surface on said at least one supporting wall and adapted to engage an outer surface of the roll, and a first upper supporting surface extending from one end of the upper concave surface, said first upper supporting surface adapted to receive said wear element such that said wear element does not substantially increase pressure from the roll on said containment blade at said first upper supporting surface.

2. A chamber blade/sealing assembly according to claim 1, wherein said first upper supporting surface includes a recess therein, and said wear element is positioned within said recess.

3. A chamber blade/sealing assembly according to claim 2, wherein said recess is bounded by a raised wall at at least one end thereof.

4. A chamber blade/sealing assembly according to claim 2, wherein said wear element has a shape and dimensions similar to those of said recess.

5. A chamber blade/sealing assembly according to claim 1, wherein said wear element is a plate material.

6. A chamber blade/sealing assembly according to claim 1, wherein said wear element is made from the same material as said blade.

7. A chamber blade/sealing assembly according to claim 1, wherein said wear element has a thickness at least equal to a thickness of said blade.

8. A chamber blade/sealing assembly according to claim 1, wherein said first upper supporting surfaces are formed by downwardly sloping flat supporting surfaces which continue at an angle from one edge of the upper concave surface.

9. A chamber blade/sealing assembly according to claim 8, wherein a height of each said first upper supporting surface at any point thereon is lower than would be required for a chamber blade/sealing assembly without said wear element, in order to account for extra thickness of the containment blade and wear element together.

10. A chamber blade/sealing assembly according to claim 1, wherein said end seal is made of one of a compressible and deformable material, and the one of compressible and deformable material of a portion of said seal containing said first upper supporting surface has a durometer which is less than a durometer of the one of compressible and deformable material of a remainder of said seal.

11. A chamber blade/sealing assembly for use with a fluid chamber which supplies fluid to a roll, said chamber blade/sealing assembly comprising:

a containment blade including an elongated thin plate having opposite ends;

a wear element which increases at least one of stiffness and wear of the thin plate, the wear element mounted to a surface of the thin plate at said opposite ends thereof; and first and second end seals for sealing first and second ends of the fluid chamber, each of said first and second end seals including:

at least one supporting wall, an upper concave surface on said at least one supporting wall and adapted to engage an outer surface of the roll, and a first upper supporting surface extending from one end of the upper concave surface, said first upper supporting surface adapted to receive said wear element such that an effective thickness of said containment blade and said wear element together between said seal and the roll remains substantially the same as the thickness of said containment blade alone.

12. A chamber blade/sealing assembly according to claim 11, wherein said first upper supporting surface includes a recess therein, and said wear element is positioned within said recess.

13. A chamber blade/sealing assembly according to claim 12, wherein said recess is bounded by a raised wall at at least one end thereof.

14. A chamber blade/sealing assembly according to claim 12, wherein said wear element has a shape and dimensions similar to those of said recess.

15. A chamber blade/sealing assembly according to claim 11, wherein said wear element is a plate material.

16. A chamber blade/sealing assembly according to claim 11, wherein said wear element is made from the same material as said blade.

17. A chamber blade/sealing assembly according to claim 11, wherein said wear element has a thickness at least equal to a thickness of said blade.

18. A chamber blade/sealing assembly according to claim 11, wherein said first upper supporting surfaces are formed by downwardly sloping flat supporting surfaces which continue at an angle from one edge of the upper concave surface.

19. A chamber blade/sealing assembly according to claim 18, wherein a height of each said first upper supporting surface at any point thereon is lower than would be required for a chamber blade/sealing assembly without said wear element, in order to account for extra thickness of the containment blade and wear element together.

20. A chamber blade/sealing assembly according to claim 11, wherein said end seal is made of one of a compressible and deformable material, and the one of compressible and deformable material of a portion of said seal containing said first upper supporting surface has a durometer which is less than a durometer of the one of compressible and deformable material of a remainder of said seal.

* * * * *